US011557839B2

(12) United States Patent
Yin et al.

(10) Patent No.: US 11,557,839 B2
(45) Date of Patent: Jan. 17, 2023

(54) DOUBLE FREQUENCY VERTICAL POLARIZATION ANTENNA AND TELEVISION

(71) Applicant: SHENZHEN TCL NEW TECHNOLOGY CO., LTD., Guangdong (CN)

(72) Inventors: Liuzhong Yin, Guangdong (CN); Kangqing Guo, Guangdong (CN); Renli Xie, Guangdong (CN); Zitong Wang, Guangdong (CN); Fujun Yang, Guangdong (CN)

(73) Assignee: Shenzhen TCL New Technology Co., Ltd., Shenzhen (CN)

( * ) Notice: Subject to any disclaimer, the term of this patent is extended or adjusted under 35 U.S.C. 154(b) by 68 days.

(21) Appl. No.: 17/266,635

(22) PCT Filed: Oct. 28, 2019

(86) PCT No.: PCT/CN2019/113711
§ 371 (c)(1),
(2) Date: Feb. 8, 2021

(87) PCT Pub. No.: WO2020/098473
PCT Pub. Date: May 22, 2020

(65) Prior Publication Data

US 2021/0351510 A1 Nov. 11, 2021

(30) Foreign Application Priority Data

Nov. 14, 2018 (CN) ..... 201821877326.2

(51) Int. Cl.
*H01Q 21/00* (2006.01)
*H01Q 5/35* (2015.01)
*H01Q 21/06* (2006.01)

(52) U.S. Cl.
CPC ..... *H01Q 5/35* (2015.01); *H01Q 21/064* (2013.01)

(58) Field of Classification Search
CPC ..... H01Q 5/35; H01Q 21/064; H01Q 1/38; H01Q 5/357; H01Q 9/0421; H01Q 21/30; H01Q 21/28
See application file for complete search history.

(56) References Cited

U.S. PATENT DOCUMENTS 4,356,492 A 10/1982 Kaloi
7,202,826 B2 4/2007 Grant et al.
(Continued)

FOREIGN PATENT DOCUMENTS

CN 204857953 U * 12/2015
CN 205141139 U 4/2016
(Continued)

OTHER PUBLICATIONS

The Extended European Search Report dated Nov. 24, 2021 From the European Patent Office Re. Application No. EP19885746.8.
(Continued)

*Primary Examiner* — Dieu Hien T Duong
(74) *Attorney, Agent, or Firm* — Nathan & Associates; Menachem Nathan

(57) ABSTRACT

Disclosed are a double frequency vertical polarization antenna and a television. The double frequency vertical polarization antenna includes a dielectric substrate, and the dielectric substrate includes a power feeding surface and a mounting surface arranged oppositely. The double frequency vertical polarization antenna further includes a power feeder and an antenna part. The power feeder is provided on the power feeding surface of the dielectric substrate, and the antenna part is provided on the mounting surface of the dielectric substrate. The antenna part includes
(Continued)

a high-frequency radiation unit and a low-frequency radiation unit spaced apart from each other. Both the high-frequency radiation unit and the low-frequency radiation unit are penetrated through the dielectric substrate and electrically connected to the power feeder.

13 Claims, 7 Drawing Sheets

(56) References Cited

U.S. PATENT DOCUMENTS

| | | | | |
|---|---|---|---|---|
| 7,417,588 | B2 | 8/2008 | Castany | |
| 8,031,129 | B2 | 10/2011 | Shtrom et al. | |
| 2005/0073456 | A1* | 4/2005 | Sievenpiper ..... | H01Q 21/30 342/175 |
| 2007/0229364 | A1 | 10/2007 | Shor | |

FOREIGN PATENT DOCUMENTS

| | | | | |
|---|---|---|---|---|
| CN | 107134639 | A | 9/2017 | |
| CN | 108134196 | A | 6/2018 | |
| CN | 207834573 | U | 9/2018 | |
| CN | 209016267 | U | 6/2019 | |
| WO | 0111721 | A1 | 2/2001 | |
| WO | 2005076409 | A1 | 8/2005 | |
| WO | WO-2008056159 | A1 * | 5/2008 | ..... H01Q 1/2208 |

OTHER PUBLICATIONS

International Search Report in corresponding PCT Application No. PCT/CN2019/113711, dated Jan. 22, 2020.

Written Opinion of the International Searching Authority in corresponding PCT Application No. PCT/CN2019/113711, dated Jan. 22, 2020.

* cited by examiner

DOUBLE FREQUENCY VERTICAL POLARIZATION ANTENNA AND TELEVISION

CROSS REFERENCE TO RELATED APPLICATIONS

This application is the National Stage of International Application No. PCT/CN2019/113711, filed on Oct. 28, 2019, which claims the benefit of Chinese Patent Application No. 201821877326.2, filed on Nov. 14, 2018 and entitled "Double Frequency Vertical polarization antenna and television", the entirety of which is hereby incorporated herein by reference.

TECHNICAL FIELD

This application relates to the field of antenna technology, and in particular to a double frequency vertical polarization antenna and a television.

BACKGROUND

With the development of communication and electronic technology, various antennas have been widely used in televisions. The styles and specifications of antennas are mostly designed according to the performance of the products used. At present, the television base is fully metalized and closed, which seriously blocks the forward signal, and cannot adapt to the influence of the base contacting wooden table, marble and other materials.

SUMMARY

The main object of this application is to provide a double frequency vertical polarization antenna, which aims to provide a double frequency vertical polarization antenna that is small in size and has a higher gain.

In order to achieve the above object, the double frequency vertical polarization antenna provided in this application includes:

a dielectric substrate, including a power feeding surface and a mounting surface oppositely arranged;

a power feeder, provided on the power feeding surface of the dielectric substrate; and an antenna part, provided on the mounting surface of the dielectric substrate, and including a high-frequency radiation unit and a low-frequency radiation unit spaced apart from the high-frequency radiation unit, both the high-frequency radiation unit and the low-frequency radiation unit being penetrated through the dielectric substrate and electrically connected to the power feeder;

the low-frequency radiation unit is arranged in a rectangular shape, a long side of the low-frequency radiation unit defines two rectangular slots parallel to a short side of the low-frequency radiation unit, the two rectangular slots are arranged at an interval, and a connecting section arranged at an angle of 45° with a horizontal plane is formed between the two rectangular slots.

In an embodiment of this application, the double frequency vertical polarization antenna further includes a combiner provided on the power feeding surface, where the high-frequency radiation unit includes a high-frequency power feeding point, the low-frequency radiation unit includes a low-frequency power feeding point, and the high-frequency power feeding point and the low-frequency power feeding point are electrically connected to the power feeder through the combiner.

In an embodiment of this application, a power feeding point structure is protruded from the connecting section, and the low-frequency power feeding point is provided on the power feeding point structure.

In an embodiment of this application, the low-frequency radiation unit is arranged in a rectangular shape, and the long side of the low-frequency radiation unit defining the two rectangular slots defines ground holes.

In an embodiment of this application, the two rectangular slots are symmetrically distributed on both sides of a line connecting midpoints of long sides of the low-frequency radiation unit.

In an embodiment of this application, the double frequency vertical polarization antenna further includes a combiner provided on the power feeding surface, where the high-frequency radiation unit includes a high-frequency power feeding point, the low-frequency radiation unit includes a low-frequency power feeding point, and the high-frequency power feeding point and the low-frequency power feeding point are electrically connected to the power feeder through the combiner.

In an embodiment of this application, a power feeding point structure is protruded from the connecting section, and the low-frequency power feeding point is provided on the power feeding point structure.

In an embodiment of this application, the high-frequency radiation unit is arranged in a circular shape, and the high-frequency power feeding point is located at a center of the high-frequency radiation unit.

In an embodiment of this application, the high-frequency radiation unit has a thickness of 1.6 mm and a diameter of 33 mm.

In an embodiment of this application, the high-frequency radiation unit further defines a metalized via spaced apart from the high-frequency power feeding point, and the metalized via is configured to excite a vertical mode.

In an embodiment of this application, multiple metalized vias are provided, and the multiple metalized vias are evenly spaced along a circumference of the high-frequency radiation unit.

This application further provides a television, mounted with a double frequency vertical polarization antenna, wherein the double frequency vertical polarization antenna includes: a dielectric substrate, including a power feeding surface and a mounting surface oppositely arranged;

a power feeder, provided on the power feeding surface of the dielectric substrate; and an antenna part, provided on the mounting surface of the dielectric substrate, and including a high-frequency radiation unit and a low-frequency radiation unit spaced apart from the high-frequency radiation unit, both the high-frequency radiation unit and the low-frequency radiation unit being penetrated through the dielectric substrate and electrically connected to the power feeder;

the low-frequency radiation unit is arranged in a rectangular shape, a long side of the low-frequency radiation unit defines two rectangular slots parallel to a short side of the low-frequency radiation unit, the two rectangular slots are arranged at an interval, and a connecting section arranged at an angle of 45° with a horizontal plane is formed between the two rectangular slots.

In an embodiment of this application, the television includes two double frequency vertical polarization antennas arranged in a mirror image.

In this application, the double frequency vertical polarization antenna uses a high-frequency radiation unit and a low-frequency radiation unit to achieve double frequency characteristics of 2.4 GHz and 5.8 GHz, with simple manufacturing process and low cost. Further, the high-frequency radiation unit is used to make the horizontal plane have good omnidirectional gain, the frequency is high to miniaturize the zero-order microstrip antenna to achieve horizontal omnidirectional radiation and vertical polarization under low profile, ensuring antenna radiation performance, and its small size and low profile facilitate the miniaturization of television. The low-frequency radiation unit may improve the gain of low-frequency radiation, and the double frequency vertical polarization antenna is mainly polarized by vertical polarization, which improves the adaptability of signal transmission to the surrounding environment.

BRIEF DESCRIPTION OF THE DRAWINGS

In order to more clearly describe the technical solutions in the embodiments of this application or the prior art, the following will briefly introduce the drawings that need to be used in the description of the embodiments or the prior art. Obviously, the drawings in the following description are only some embodiments of this application. For those of ordinary skill in the art, without creative work, other drawings can be obtained according to the structures shown in these drawings.

Figure 1:
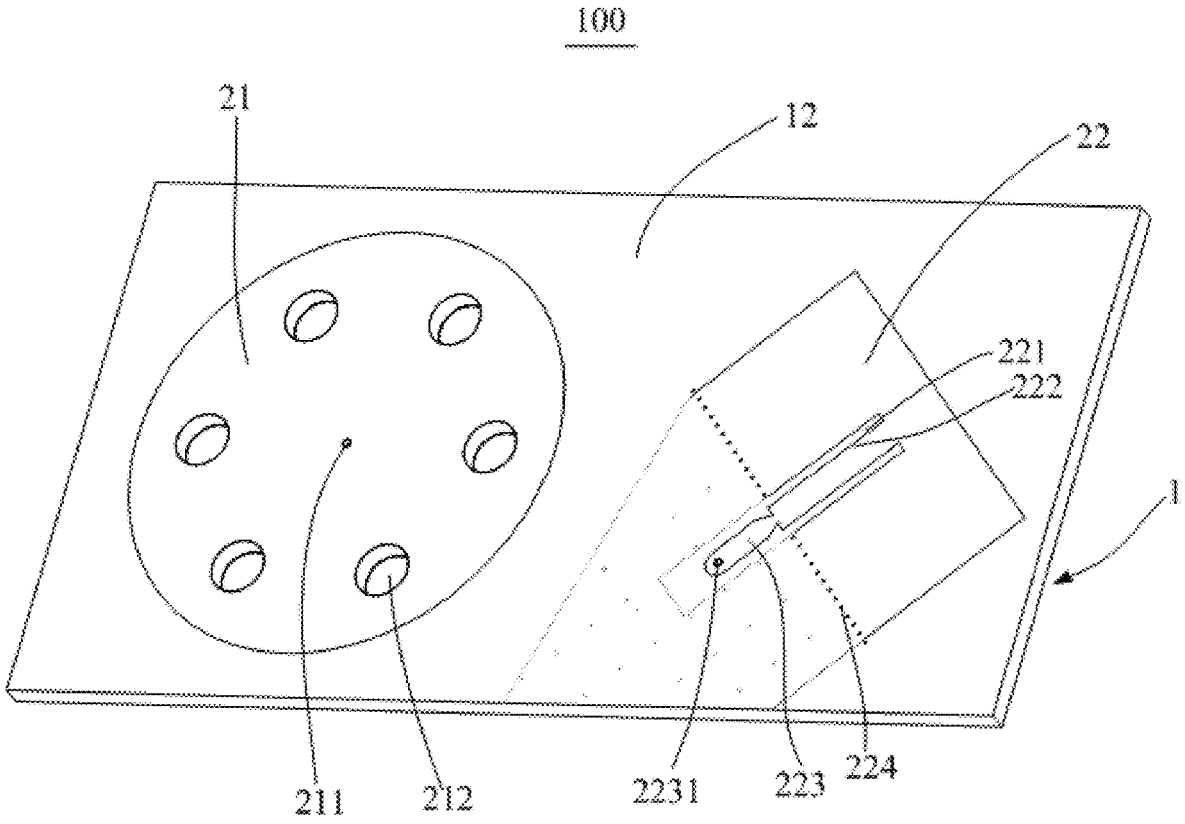
FIG. 1 is a schematic structural diagram of a double frequency vertical polarization antenna according to an embodiment of this application.

The realization, functional characteristics, and advantages of the purpose of this application will be further described in conjunction with the embodiments and with reference to the accompanying drawings.

DETAILED DESCRIPTION OF THE EMBODIMENTS

The technical solutions in the embodiments of this application will be described clearly and completely in conjunction with the drawings in the embodiments of this application. Obviously, the described embodiments are only a part of the embodiments of this application, but not all the embodiments. Based on the embodiments in this application, all other embodiments obtained by those of ordinary skill in the art without creative work shall fall within the protection scope of this application.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In this application, unless otherwise clearly specified and limited, the terms "connected", "fixed", etc. should be understood in a broad sense. For example, "fixed" can be a fixed connection, a detachable connection, or a whole; it can be a mechanical connection or an electrical connection; it can be a direct connection or an indirect connection through an intermediate medium, and it can be the internal communication between two components or the interaction relationship between two components, unless specifically defined otherwise. For those of ordinary skill in the art, the specific meanings of the above-mentioned terms in this application can be understood according to specific circumstances.

In addition, the descriptions related to "first", "second", etc. in this application are for descriptive purposes only, and cannot be understood as indicating or implying their relative importance or implicitly indicating the number of indicated technical features. Thus, the features defined as "first" and "second" may include at least one of the features either explicitly or implicitly. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, nor within the scope of protection required by this application.

This application provides a double frequency vertical polarization antenna 100.

Figure 2:
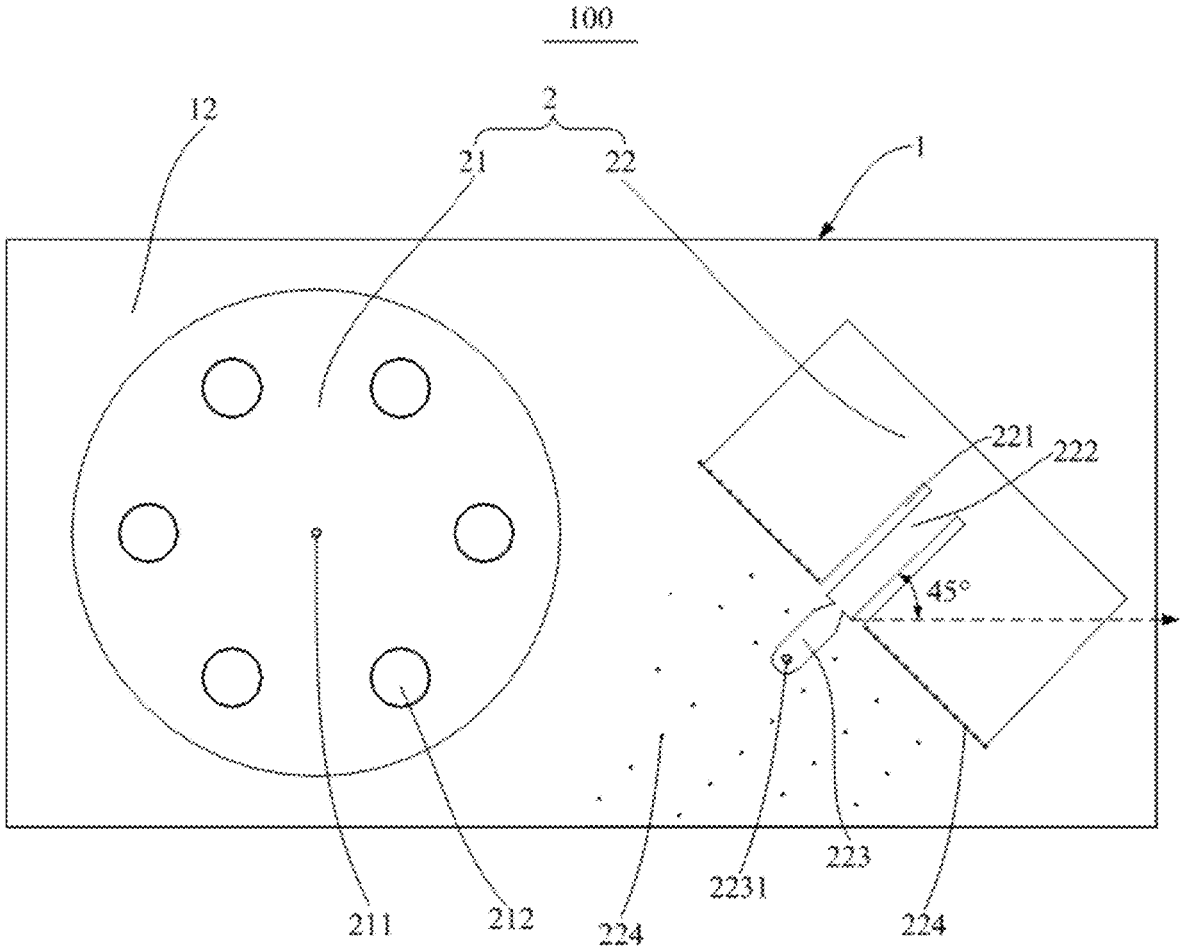
FIG. 2 is a top view of the double frequency vertical polarization antenna in FIG. 1.
Figure 3:
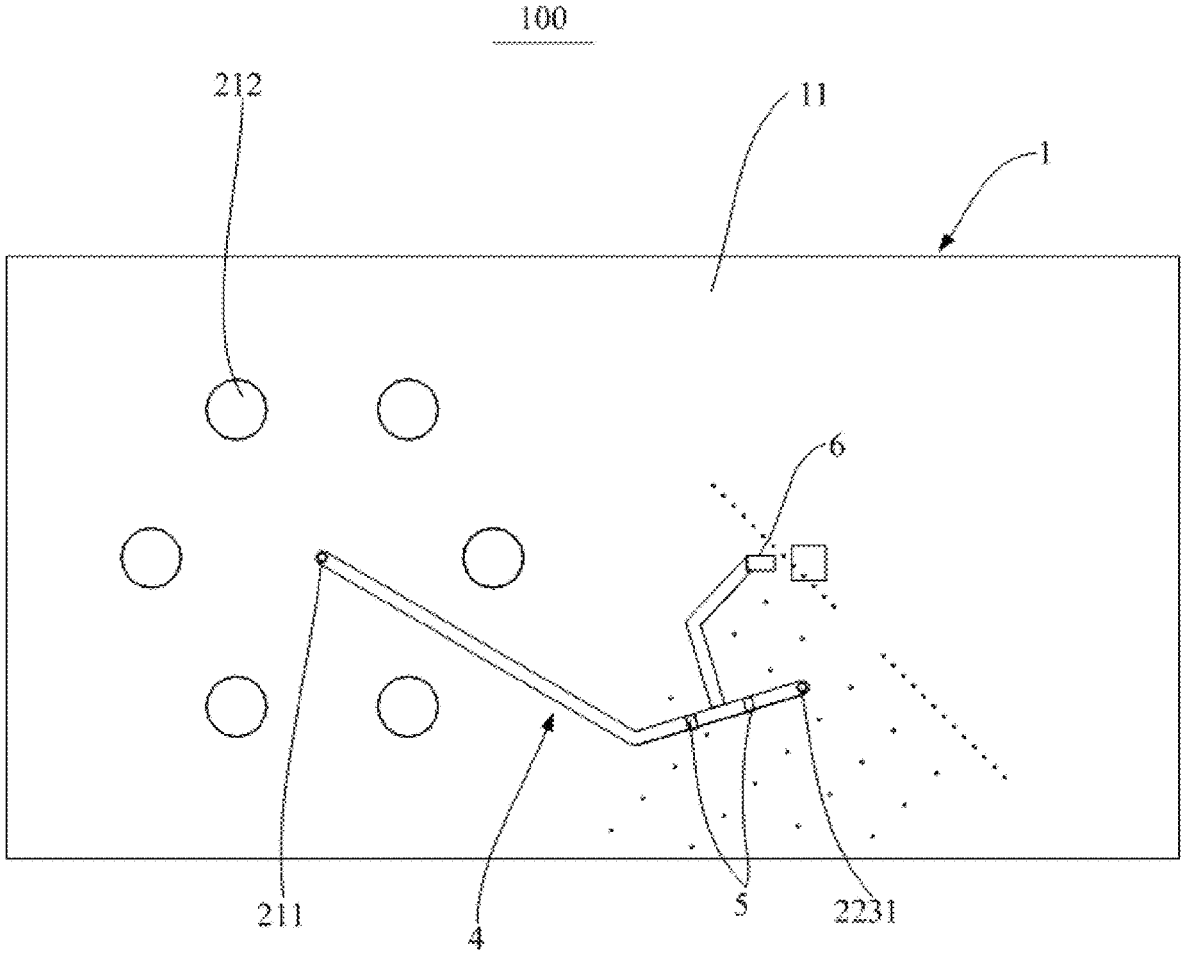
FIG. 3 is a bottom view of the double frequency vertical polarization antenna in FIG. 1.
Figure 4:
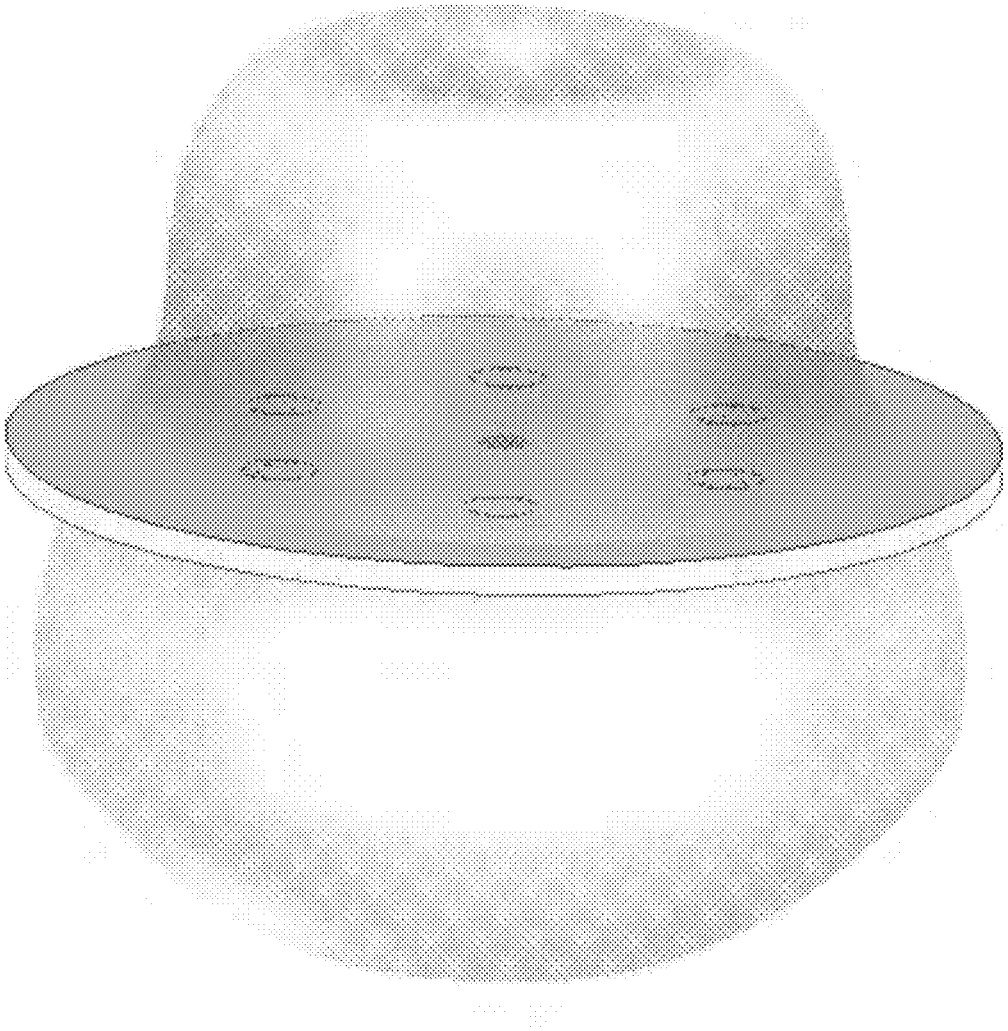
FIG. 4 is a simulated 3D radiation pattern of a 5.8 GHz band of the double frequency vertical polarization antenna in FIG. 1.
Figure 5:
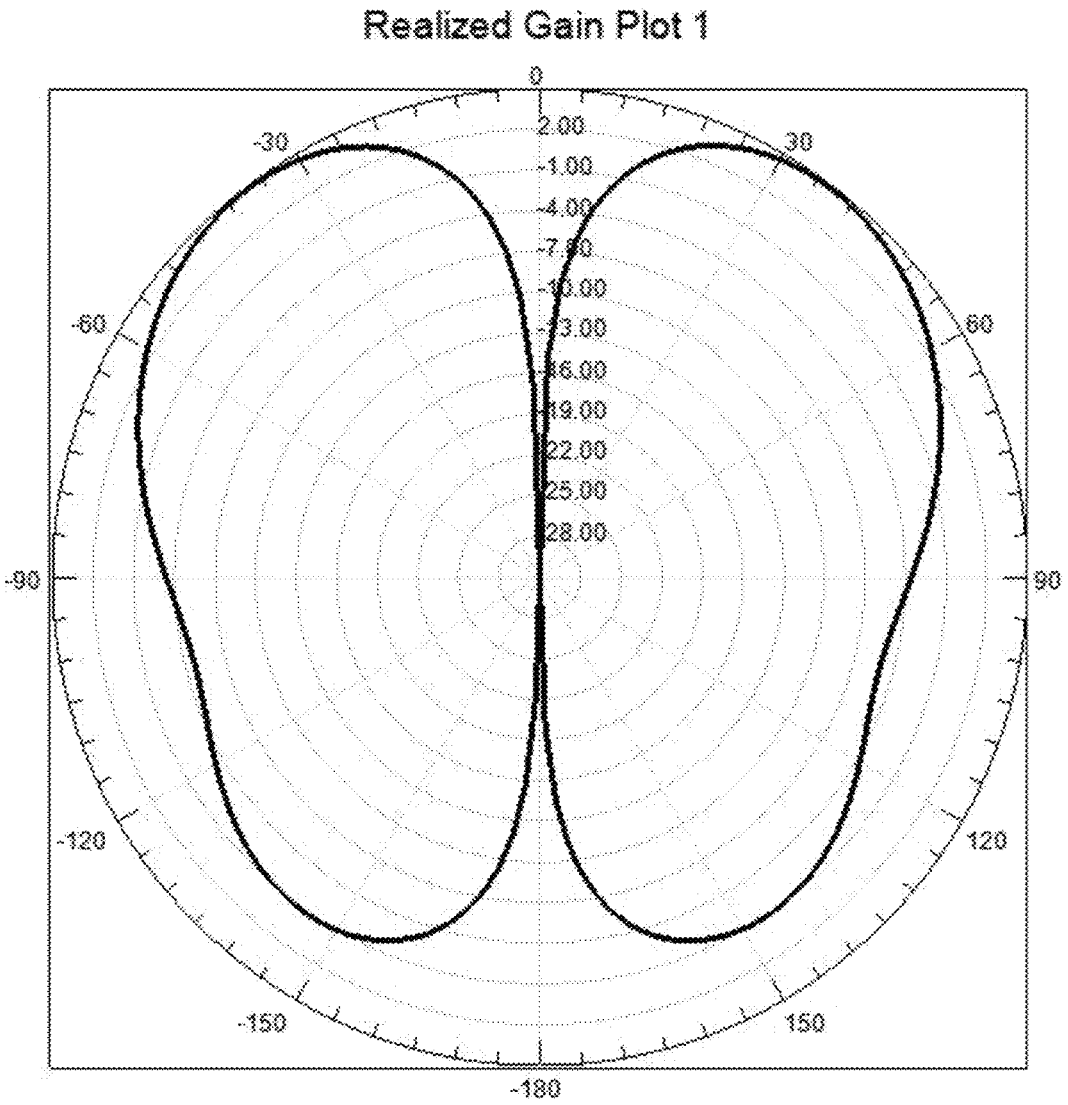
FIG. 5 is a cross-sectional view of the simulated 3D radiation pattern of the microstrip antenna in FIG. 4.
Figure 6:
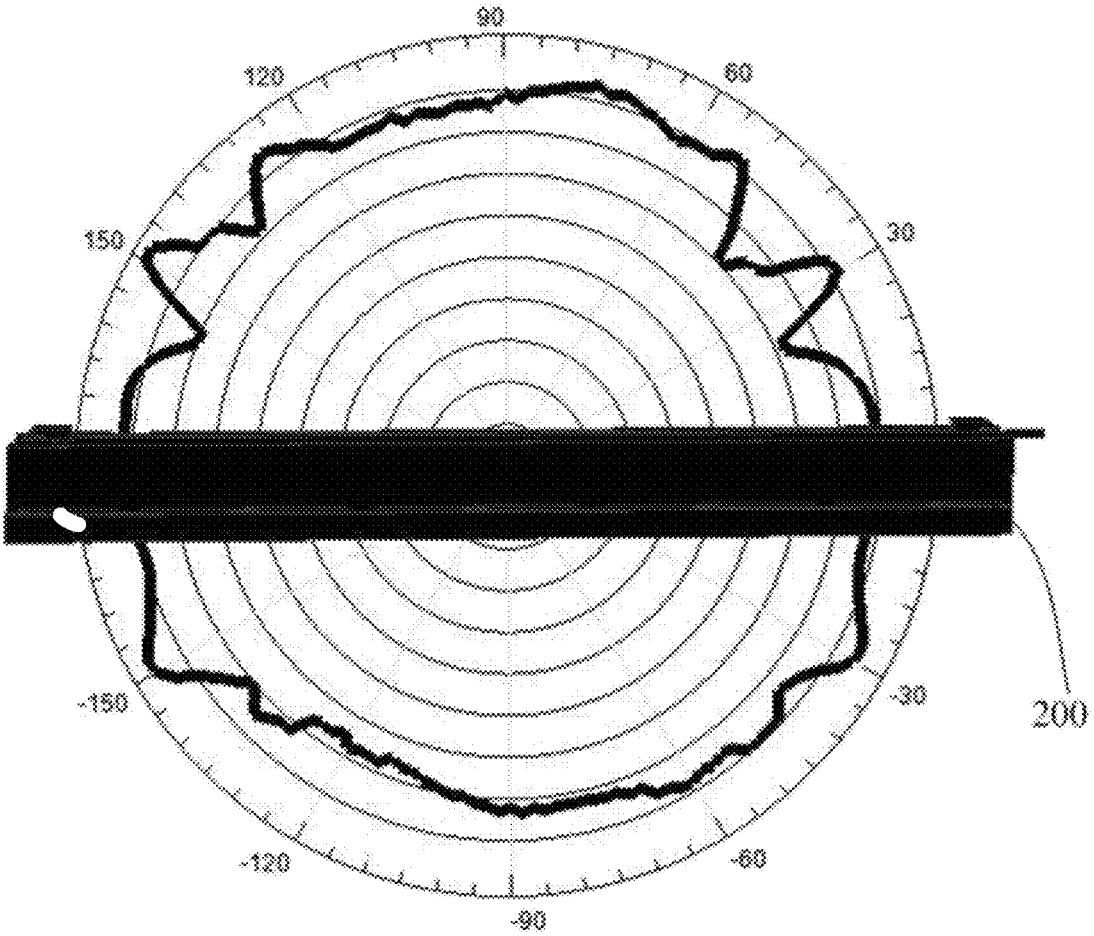
FIG. 6 is a cross-sectional view of the simulated 3D radiation pattern of the microstrip antenna in FIG. 4 from another perspective.

Referring to FIGS. 1 to 3, the double frequency vertical polarization antenna 100 includes a dielectric substrate 1, and the dielectric substrate 1 includes a power feeding surface 11 and a mounting surface 12 arranged oppositely. The double frequency vertical polarization antenna 100 further includes a power feeder 6 and an antenna part 2. The power feeder 6 is provided on the power feeding surface 11 of the dielectric substrate 1, and the antenna part 2 is provided on the mounting surface 12 of the dielectric substrate 1. The antenna part 2 includes a high-frequency radiation unit 21 and a low-frequency radiation unit 22 spaced apart from each other. Both the high-frequency radiation unit 21 and the low-frequency radiation unit 22 are penetrated through the dielectric substrate 1 and electrically connected to the power feeder 6.

Specifically, the dielectric substrate 1 is a double-layer PCB (Printed Circuit Board), and the double-layer circuit board not only facilitates impedance matching of the double frequency vertical polarization antenna 100, but also facilitates power feeding. In addition, the material selection of the dielectric substrate 1 will affect the gain and other performance of the double frequency vertical polarization antenna 100, and the thickness of the dielectric substrate 1 will also affect the volume and weight of the double frequency vertical polarization antenna 100; and the dielectric substrate 1 is generally made of non-metal material. In this embodiment, the shape of the dielectric substrate 1 is rectangular, and the material of the dielectric substrate 1 may be FR4 epoxy resin, the dielectric constant is 4.4, the thickness is 1.6 mm, the length is 78 mm, and the width is 40 mm. Such a design not only has low cost, but also may ensure that good antenna operating characteristics are maintained at different operating frequencies.

The double frequency vertical polarization antenna 100 of this application adopts the high-frequency radiation unit 21 and the low-frequency radiation unit 22 to achieve double frequency characteristics of 2.4 GHz and 5.8 GHz, and has a simple manufacturing process and low cost. The high-frequency radiation unit 21 is used to make the horizontal plane have good omnidirectional gain, the frequency is high to miniaturize the zero-order microstrip antenna to achieve horizontal omnidirectional radiation and vertical polarization under low profile, ensuring antenna radiation performance, and its small size and low profile facilitate the miniaturization of television 200. The low-frequency radiation unit 22 may improve the gain of low-frequency radiation. The double frequency vertical polarization antenna 100 is mainly polarized by vertical polarization, which improves the adaptability of signal transmission to the surrounding environment.

Referring to FIGS. 1 and 2, the low-frequency radiation unit 22 is arranged in a rectangular shape, a long side of the low-frequency radiation unit 22 defines two rectangular slots 221 parallel to a short side of the low-frequency radiation unit 22, the two rectangular slots 221 are arranged at intervals, and a connecting section 222 is formed between the two rectangular slots 221.

In this embodiment, the low-frequency radiation unit 22 is rectangular, and a long side of the low-frequency radiation unit 22 defining the two rectangular slots 221 defines ground holes 224. In addition, the dielectric substrate 1 further defines ground holes 224 adjacent to the said long side. The number of ground holes 224 will affect the radiation efficiency of the double frequency vertical polarization antenna 100. Generally speaking, the greater the number of ground holes 224, the higher the radiation efficiency of the double frequency vertical polarization antenna 100. In this embodiment, the ground holes 224 are evenly spaced, and a reasonable density of the metalized vias 212 is used as a short circuit to realize a miniaturized design of the antenna and increase the gain of the double frequency vertical polarization antenna 100.

In an embodiment of this application, shapes of the two rectangular slots 221 are the same, and the distribution positions of the rectangular slots 221 are not specifically limited. However, the position of the connecting section 222 changes as the positions of the two rectangular slots 221 change. When the two rectangular slots 221 are symmetrically distributed on both sides of a line connecting midpoints of the long sides of the low-frequency radiation unit 22, the connecting section 222 is located at the midpoint of the long side of the low-frequency radiation unit 22, which is beneficial to reduce the out-of-roundness of the low-frequency radiation.

Figure 7:
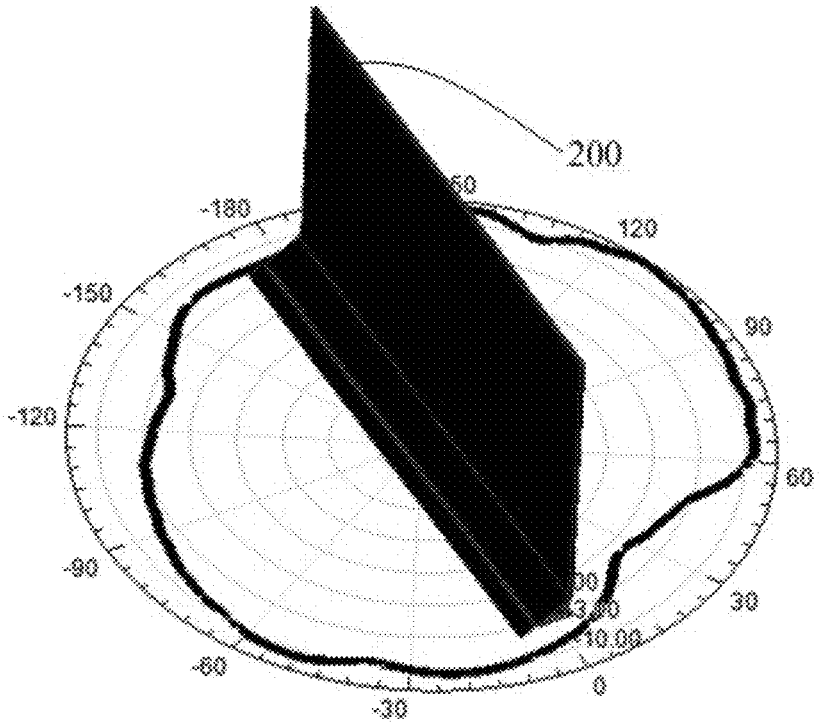
FIG. 7 is a radiation pattern of a 2.4 GHz band of the double frequency vertical polarization antenna in FIG. 1.
Figure 8:
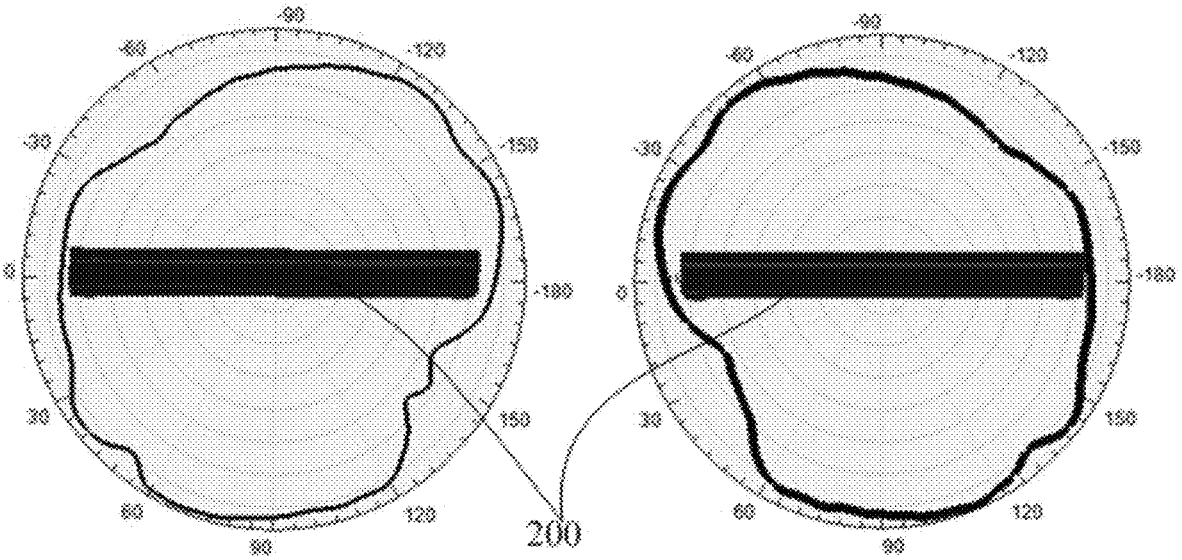
FIG. 8 is a schematic diagram showing complementation of blind areas of the radiation directions of the 2.4 GHz band where the two double frequency vertical polarization antennas in FIG. 1 are mirrored.

Referring to FIG. 2, FIG. 7 and FIG. 8, the connecting section 222 is arranged at an angle of 45° to a horizontal plane.

In this embodiment, the connecting section 222 of the low-frequency radiating unit 22 is arranged at an angle of 45° to the horizontal plane. Two double frequency vertical polarization antennas 100 may be provided in the product, and the two are arranged in a mirror image. The two antennas with a 45° diagonal layout may achieve orthogonal mutual blind compensation, thereby achieving omnidirectional coverage, and achieve horizontal omnidirectional gain complementary.

Referring to FIG. 3, the double frequency vertical polarization antenna 100 further includes a combiner 4 provided on the power feeding surface 11, where the high-frequency radiation unit 21 includes a high-frequency power feeding point 211, the low-frequency radiation unit 22 includes a low-frequency power feeding point 2231, and the high-frequency power feeding point 211 and the low-frequency power feeding point 2231 are electrically connected to the power feeder 6 through the combiner 4.

In this embodiment, the high-frequency power feeding point 211 and the low-frequency power feeding point 2231 may be metalized vias. The high-frequency radiation unit 21 and the low-frequency radiation unit 22 on the mounting surface 12 of the dielectric substrate 1 are connected to the combiner 4 located on the mounting surface 11 of the dielectric substrate 1 through the metalized vias, and then connected to the power feeder 6 through the combiner 4. Double frequency communication is realized by combining the channels, and the structure is compact, thereby facilitating miniaturized design of the double frequency vertical polarization antenna 100. Certainly, a radio frequency switch may also be used to achieve double frequency communication. In addition, the high-frequency power feeding line and the low-frequency power feeding line are provided with a band pass filter 5 to reduce interference and make the voice of the television 200 smoother without the problem of screen jamming.

Referring to FIGS. 1 and 2, a power feeding point structure 223 is protruded from the connecting section 222, and the low-frequency power feeding point 2231 is provided on the power feeding point structure 223.

The power feeding point structure 223 is protruded from the connecting section 222, and the feeding structure is protruded from an edge of a long side of the rectangular low-frequency radiation unit 22. A width of the power feeding point structure 223 may be smaller than a width of the connecting section 222, and may be equal to or greater than a width of the connecting section 222, which is not limited here. In an optional embodiment, the width of the power feeding point structure 223 is smaller than the width of the connecting section 222, which is beneficial to achieve impedance matching.

Please continue to refer to FIGS. 2 and 4 to 6, the high-frequency radiation unit 21 is arranged in a circular shape, and the high-frequency power feeding point 211 is located at a center of the high-frequency radiation unit.

In this embodiment, the high-frequency radiation unit 21 is arranged in a circular shape, which is beneficial to reduce the out-of-roundness of high-frequency radiation, so as to achieve horizontal omnidirectional radiation, which is beneficial to increase the gain of the television 200. Specifically, the high-frequency radiation unit 21 has a thickness of 1.6 mm and a diameter of 33 mm.

Referring to FIGS. 1 to 3, the high-frequency radiation unit 21 further defines a metalized via 212 spaced apart from the high-frequency power feeding point 211, and the metalized via 212 is configured to excite a vertical mode.

The metalized via 212 refers to a via with solidified metal inside, so that the via is electrically conductive. A hole may be drilled on the dielectric substrate 1, and then liquid metal (such as copper) may be injected into the hole and solidified to form a metalized via 212. In this embodiment, the metalized via 212 is configured to excite a vertical mode to meet the requirements of the vertical and horizontal polarization components of the high-frequency antenna. Optionally, multiple metalized vias 212 are evenly spaced along the circumference of the high-frequency radiation unit 21, and a reasonable density of metalized vias 212 may be used to achieve a miniaturized antenna design.

This application further provides a television 200, which is mounted with a double frequency vertical polarization antenna 100. For the specific structure of the double frequency vertical polarization antenna 100, refer to the above-mentioned embodiments. Because the television 200 adopts all the technical solutions of all the above-mentioned embodiments, it has at least all the effects brought by the technical solutions of the above-mentioned embodiments, which will not be repeated here.

The above descriptions are only optional embodiments of the application, and do not limit the scope of the patents of the application. Any equivalent structural transformation made by using the description and drawings of the application under the concept of the application of the application, or directly/Indirect applications in other related technical fields are included in the scope of patent protection of this application.

What is claimed is:

1. A double frequency vertical polarization antenna, comprising:

a dielectric substrate, comprising a power feeding surface and a mounting surface oppositely arranged;

a power feeder, provided on the power feeding surface of the dielectric substrate; and an antenna part, provided on the mounting surface of the dielectric substrate, and comprising a high-frequency radiation unit and a low-frequency radiation unit spaced apart from the high-frequency radiation unit, both the high-frequency radiation unit and the low-frequency radiation unit being penetrated through the dielectric substrate and electrically connected to the power feeder;

the low-frequency radiation unit is arranged in a rectangular shape, a long side of the low-frequency radiation unit defines two rectangular slots parallel to a short side of the low-frequency radiation unit, the two rectangular slots are arranged at an interval, and a connecting section arranged at an angle of 45° with a horizontal plane is formed between the two rectangular slots.

2. The double frequency vertical polarization antenna of claim 1, further comprising a combiner provided on the power feeding surface, wherein the high-frequency radiation unit comprises a high-frequency power feeding point, the low-frequency radiation unit comprises a low-frequency power feeding point, and the high-frequency power feeding point and the low-frequency power feeding point are electrically connected to the power feeder through the combiner.

3. The double frequency vertical polarization antenna of claim 2, wherein a power feeding point structure is protruded from the connecting section, and the low-frequency power feeding point is provided on the power feeding point structure.

4. The double frequency vertical polarization antenna of claim 1, wherein the low-frequency radiation unit is arranged in a rectangular shape, and the long side of the low-frequency radiation unit defining the two rectangular slots defines ground holes.

5. The double frequency vertical polarization antenna of claim 1, wherein the two rectangular slots are symmetrically distributed on both sides of a line connecting midpoints of long sides of the low-frequency radiation unit.

6. The double frequency vertical polarization antenna of claim 5, further comprising a combiner provided on the power feeding surface, wherein the high-frequency radiation unit comprises a high-frequency power feeding point, the low-frequency radiation unit comprises a low-frequency power feeding point, and the high-frequency power feeding point and the low-frequency power feeding point are electrically connected to the power feeder through the combiner.

7. The double frequency vertical polarization antenna of claim 6, wherein a power feeding point structure is protruded from the connecting section, and the low-frequency power feeding point is provided on the power feeding point structure.

8. The double frequency vertical polarization antenna of claim 7, wherein the high-frequency radiation unit is arranged in a circular shape, and the high-frequency power feeding point is located at a center of the high-frequency radiation unit.

9. The double frequency vertical polarization antenna of claim 8, wherein the high-frequency radiation unit has a thickness of 1.6 mm and a diameter of 33 mm.

10. The double frequency vertical polarization antenna of claim 8, wherein the high-frequency radiation unit further defines a metalized via spaced apart from the high-frequency power feeding point, and the metalized via is configured to excite a vertical mode.

11. The double frequency vertical polarization antenna of claim 10, wherein multiple metalized vias are provided, and the multiple metalized vias are evenly spaced along a circumference of the high-frequency radiation unit.

12. A television, mounted with a double frequency vertical polarization antenna, wherein the double frequency vertical polarization antenna comprises: a dielectric substrate, comprising a power feeding surface and a mounting surface oppositely arranged;

a power feeder, provided on the power feeding surface of the dielectric substrate; and an antenna part, provided on the mounting surface of the dielectric substrate, and comprising a high-frequency radiation unit and a low-frequency radiation unit spaced apart from the high-frequency radiation unit, both the high-frequency radiation unit and the low-frequency radiation unit being penetrated through the dielectric substrate and electrically connected to the power feeder;

the low-frequency radiation unit is arranged in a rectangular shape, a long side of the low-frequency radiation unit defines two rectangular slots parallel to a short side of the low-frequency radiation unit, the two rectangular slots are arranged at an interval, and a connecting section arranged at an angle of 45° with a horizontal plane is formed between the two rectangular slots.

13. The television of claim 12, comprising two double frequency vertical polarization antennas arranged in a mirror image.

* * * * *